US006240849B1

(12) United States Patent
Holler

(10) Patent No.: US 6,240,849 B1
(45) Date of Patent: Jun. 5, 2001

(54) PROJECTILE WITH EXPANDING MEMBERS

(76) Inventor: Christopher A. Holler, 2449 Via Sienna Ave., Winter Park, FL (US) 32789

( * ) Notice: Subject to any disclaimer, the term of this patent is extended or adjusted under 35 U.S.C. 154(b) by 0 days.

(21) Appl. No.: 09/329,820

(22) Filed: Jun. 10, 1999

(51) Int. Cl.[7] ..... F42B 12/02

(52) U.S. Cl. ..... 102/439; 102/400; 102/501; 102/517; 89/1.34; 244/3.3

(58) Field of Search ..... 102/371, 400, 102/439, 501, 504, 507, 517; 244/3.3; 89/1.34

(56) References Cited

U.S. PATENT DOCUMENTS

| | | | | |
|---|---|---|---|---|
| 609,003 | * | 8/1898 | Borelli | 102/400 |
| 724,326 | * | 3/1903 | Pepperling | 102/507 |
| 1,218,832 | * | 3/1917 | Bondurant | 102/400 |
| 1,225,497 | * | 5/1917 | Rodzikevitch | 102/400 |
| 1,318,858 | * | 10/1919 | Frick | 102/400 |
| 1,464,032 | * | 8/1923 | Daynix | 102/400 |
| 3,952,662 | | 4/1976 | Greenless . | |
| 4,008,667 | | 2/1977 | Look . | |
| 4,136,616 | | 1/1979 | Schirneker . | |
| 4,665,827 | | 5/1987 | Ellis, II . | |
| 4,776,279 | | 10/1988 | Pejsa . | |
| 5,062,974 | * | 11/1991 | Van Meter | 102/511 |
| 5,221,809 | | 6/1993 | Cuadros . | |
| 5,450,795 | | 9/1995 | Adelman . | |

FOREIGN PATENT DOCUMENTS

| | | | | |
|---|---|---|---|---|
| 306326 | * | 5/1917 | (DE) | 102/504 |
| 314304 | * | 9/1919 | (DE) | 102/400 |
| 16234 | * | 11/1916 | (GB) | 102/400 |

* cited by examiner

*Primary Examiner*—Harold J. Tudor
(74) *Attorney, Agent, or Firm*—Greenberg Traurig LLP; Anthony R. Barkume

(57) ABSTRACT

A projectile attachment is disclosed that has open-biased arm members that can be either mounted directly onto the projectile base or may be mounted to a mutual connection means which is then attached to the projectile base. The arms are compressed into a restrained position so that they may be inserted into the casing of the bullet. Upon firing, the arms extend to the unrestrained position. Upon impact the projectile penetrates the target then the extended arm members engage the target surface to cause widespread damage while slowing the projectile. The members may optionally have hook-like ends.

20 Claims, 3 Drawing Sheets

PROJECTILE WITH EXPANDING MEMBERS

BACKGROUND OF THE INVENTION

The present invention generally relates to modifications to projectiles where an expandable attachment member is joined to the base of the projectile body.

Prior art bullets used to create lethal wounds have undergone significant modifications to allow the projectile body to have a relatively small cross section with an aerodynamic shape for in-flight stability and increased accuracy over a longer range. Upon impact with the target, the projectile body deforms rapidly and increases in cross section, causing widespread damage to the impacted tissue. Various parameters of the shape and materials used in these projectiles control the level of destruction within the target. While these projectiles potentially lead to an increased risk of harm to other than the intended target due to their increased range, measures have been taken to limit the ability for the projectile to pass through the target.

U.S. Pat. No. 4,776,279 discloses a projectile of that has a smooth aerodynamic shape with a soft tip and core, where the projectile body has slits in the exterior to cause the projectile body to expand in a controlled manner upon impact. U.S. Pat. No. 4,136,616, discloses a hollow projectile that rapidly deforms on impact and increases in surface area causing widespread destruction and limiting the likelihood of the projectile passing through the target. U.S. Pat. No. 4,665,827 discloses a projectile that has a screw inserted in the tip that upon impact causes the arms of the projectile to fan out and cause increased destruction.

A different approach to projectile design has focussed on the addition of range limiting features to projectiles to reduce the likelihood of severe harm to those beyond the effective range of the bullet. These bullets still provide a high level of lethality while reducing the overall range of the projectile body. Projectiles of this type expand upon firing or while in-flight, where the increased surface area slows the projectile, thereby limiting the range of the projectile. U.S. Pat. No. 4,006,667 discloses one example of a projectile that upon firing, changes shape causing a plurality of arms to deploy from the sides of the projectile body. The spin of the projectile as it exits the firearm causes a centrifugal force to separate the arms from the projectile body. The increased surface area of the arms cause the projectile to slow down.

Bullets that increase in size or alter their own shape in-flight are additionally used by police for crowd control applications where lethality and penetration of the projectile is not desired. These projectiles are made to deform rapidly and may modify their shape based on centrifugal forces imparted by the rifling of the barrel. U.S. Pat. No. 5,450,795 discloses one type of projectile where a gel filled sack is surrounded by a fabric cover. Upon firing the cover acts to slow the projectile (sack), and upon impact the sack may rupture further distributing the load. U.S. Pat. No. 3,952,662 is another projectile that has arms that extend from the side of the projectile body upon firing, where the arms slow the projectile and additionally help to distribute load transferred to the impacted region of the target.

What is desired therefore is a projectile modification where the projectile body may be of any type desired by the user, where the modified projectile has a very low potential to pass through the target. The modification should be simple to add to a projectile body and should provide an additional braking force once the projectile has sufficiently entered the target. While prior art projectiles may use mechanical or aerodynamic or impact force means to modify the shape of the projectile, none offer the ability to externally modify a prior art bullet where arms spring out radially to extend the reach of the projectile immediately upon firing. Upon impact the projectile passes into the target according to the design properties of the particular projectile modified, then hook-like projections on the extended arms engage the surface to pull and tear the surface and internal tissue thereby increasing damage and reducing the potential for the projectile to passthrough the target.

SUMMARY OF THE INVENTION

The present invention presents an improved bullet modification capable of creating more damage than a standard bullet that limits the potential for the projectile to pass through the target. The bullet modification is for an expandable attachment for a lethal projectile that comprises a plurality of deformable open biased members having a joining end and a second end; wherein the joining end of the deformable members are attached to the rear of a projectile such that upon firing the deformable members radially expand with respect to each other, springing forward with respect to the direction of travel of the projectile. When the projectile penetrates the object the member ends engage the object to create more widespread destruction of the object. The member ends effectively slow the projectile once inside the object to limit penetration distance and reduce the potential for pass through of the projectile.

The deformable open biased members are preferably made of a hardened heat resistant material such as steel. The material of the deformable open-biased members have a first memory position in an unrestrained condition and a second memory position in a restrained condition where the first memory position is naturally assumed when in an unrestrained condition, and the second memory position is assumed in a restrained condition. The expandable attachment may have a coating applied to prevent wear of the barrel of the firearm due to contact with the hardened members.

The deformable members have the second end configured in a hook-like shape where the hook does not contact the casing or barrel during firing.

In a second embodiment, the deformable open-biased members are first attached to a mutual connection means where the connection means is attached to the projectile base projectile using a variety of connection types such as a weld, bond or threaded joint.

A bullet and casing is also disclosed to house the projectile body with the expandable attachment where the members are compressed toward each other such that they assume the restrained memory position where the member arms fit inside the casing. The chamber area is filled with powder surrounding the deformable members. When the bullet is fired, the primer ignites the powder, the expanding gases cause the projectile to travel along a barrel of a firearm, the deformable members contact the barrel walls as the projectile travels the length of the barrel, upon exiting the barrel the deformable members outwardly expand to achieve their unrestrained condition with respect to each other.

DETAILED DESCRIPTION OF THE PREFERRED EMBODIMENT

Figure 1:
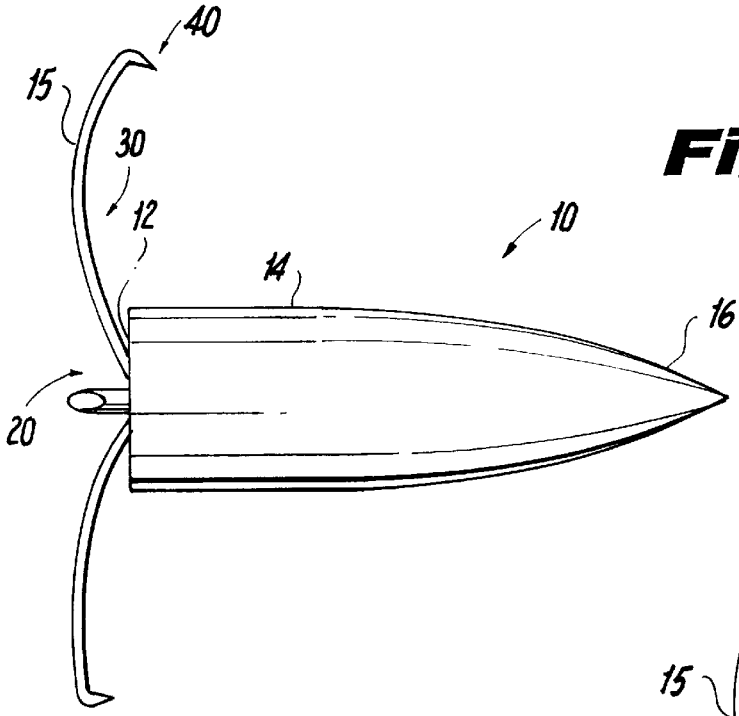
FIG. 1 is a side view of expandable attachment to a projectile body of the preferred embodiment of the present invention.

With reference to FIG. 1, the present invention presents an improved bullet modification capable of creating more damage than a standard bullet that limits the potential for the projectile to pass through the target. The modification comprises the attachment of a plurality of arm-like members to the base of a projectile. The projectile body 10 may comprise any standard or specialized projectile body that has a base 12, side wall 14 and tip 16 where the projectile form may be of any shape. The base 12 of the projectile may be substantially flat or have alternative shapes that may be suitably modified to allow for the attachment of the expandable attachment of the present invention. In the preferred embodiment, the base 12 is made of solid material that can accept the individual members 15 or the mutual connection member 50 (see FIG. 2).

Figure 2:
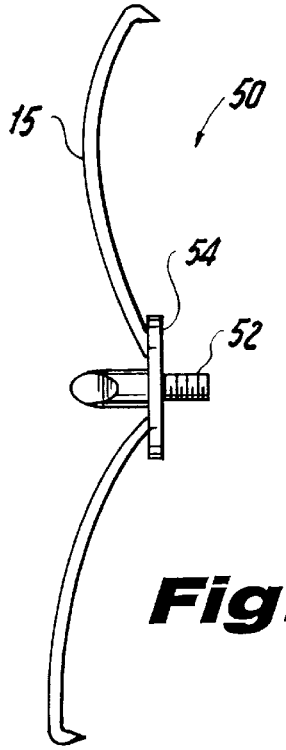
FIG. 2 is a side view of the second embodiment of the expandable attachment of the present invention.
Figure 3:
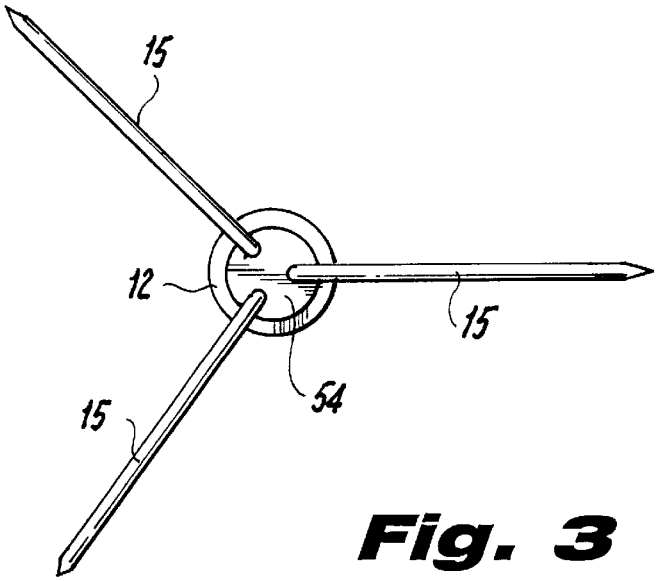
FIG. 3 is bottom view of the expandable attachment of the present invention in the radially expanded unrestrained condition.

In one embodiment, the base 12 of the projectile is modified to receive the deformable open bias members 15. The attachment of each deformable member 15 must be established so that it is oriented to extend over the broadest possible range when in an unrestrained position. The deformable members 15 may be attached directly to the bullet base 10 as shown in FIG. 1, or the members 15 may be attached to a mutual connection means 54 that has the members 15 pre-configured. The mutual connection means may then be attached to the base 12 of the projectile body 10 (see FIG. 2). The actual attachment connection may comprise a bond joint such as a weld joint (not shown), threaded connection 52, or other type of permanently fixed or removable connection. FIG. 3 shows the projectile from the underside where the members 15 are extended to their maximum radially extended range.

Each individual member 15 has a joining end 20 middle portion 30 and a second end 40. In the preferred embodiment, the projectile body base 12 or the mutual connection means 54 has aperture means to receive the joining end of each member 15. The middle portion 30 is a gently curved surface that is predisposed to the unrestrained open position as shown in FIGS. 1 and 2. The members may have a flat, concave or ridged cross section. The second end 40 may be configured optionally with barbed or hook-like ends (see 40 of FIG. 1). In another embodiment, the middle portion may additionally have a plurality of hooks or barbs located along the members, preferably located away from the barrel and casing contact range 32 of the middle portion 30 (see FIG. 4).

The deformable open biased members 15 are preferably made of a hardened heat resistant material such as spring steel. The material properties of the members 15 may have a first memory position in an unrestrained open condition and a second memory position in a restrained condition where the first memory position is naturally assumed when in an unrestrained condition, and the second memory position is assumed in a restrained condition. The heat generated by firing the projectile may optionally cause the arms to assume a position of engagement with a target object by affecting the material properties to cause the arms to bias in a forward direction. The expandable attachment may have a coating applied to the contact region 32 of the member 15 to prevent wear of the barrel of the firearm due to contact with the hardened members. A commercially available coating such as molybdenum disulfide may be applied to the contact region 32 of the member. Other coatings providing similar protection may also be utilized. In an alternative embodiment, the expandable member may be made of several different materials joined along the length of the member providing the biasing and wear resistant properties suitable for this attachment.

Figure 5:
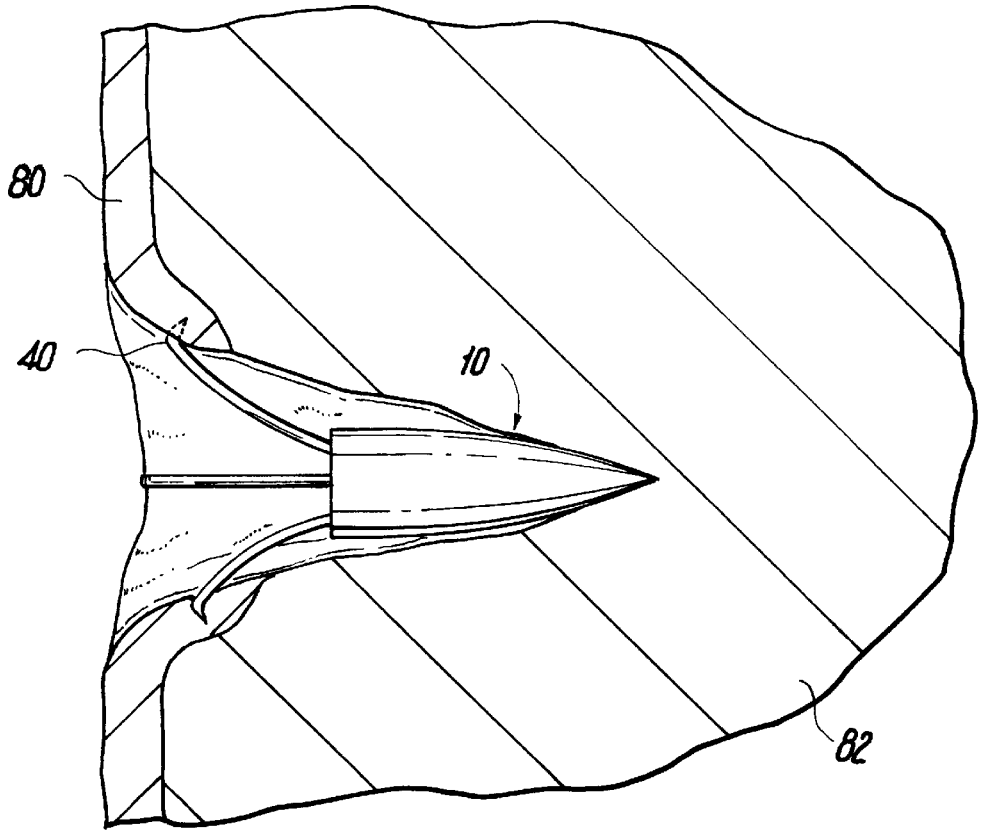
FIG. 5 is a view of the projectile upon engagement of the expandable attachment with the tissue of the target object.
Figure 6:
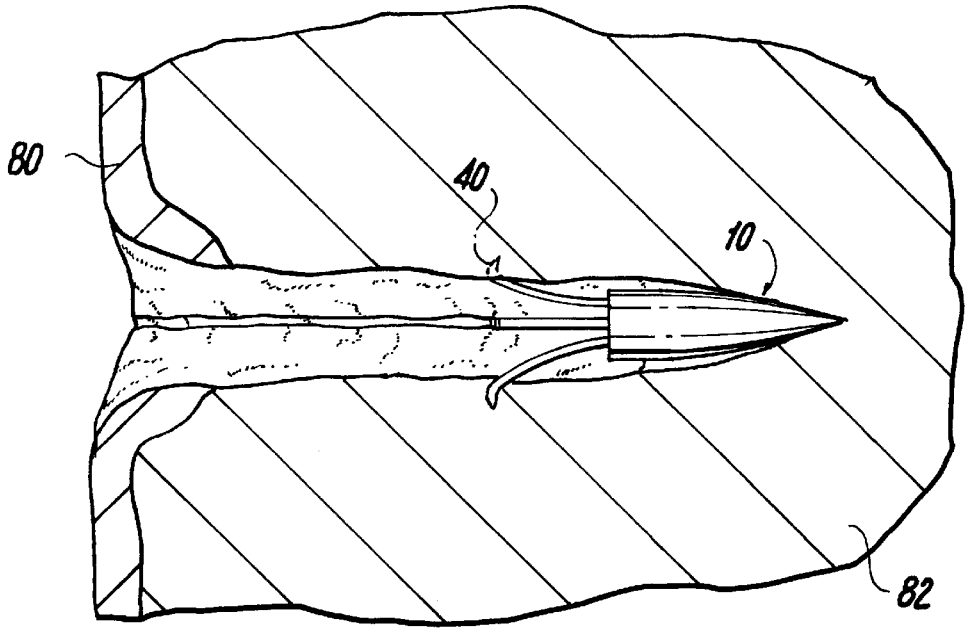
FIG. 6 is a view of the projectile of the projectile body and the expandable attachment at rest following penetration with the tissue of the target object.

In flight, the projectile has the profile shown in FIG. 1 with the members 15 sprung in a forward configuration with respect to the direction of travel. When the projectile 10 penetrates the target object (see FIG. 5), the member ends 40 and middle portion 30 engage the object to create more widespread destruction of the object. The surface 80 is pulled or torn as the member ends 40 engage the surface 80. As the projectile penetrates deeper into the target (see FIG. 6), the ends 40 and middle portion engage the internal tissue 82 of the target object. The ends 40 may additionally become engaged upon hard structure, such as bone to limit the forward travel of the projectile through the target object, thereby reducing the likelihood of the projectile body passing through the target object. The projectile body may deform substantially based on the projectile body type. The increased drag generated by the members 15 therefore, effectively slow the projectile once they engage the object to limit penetration distance and reduce the potential for pass through of the projectile.

Figure 4:
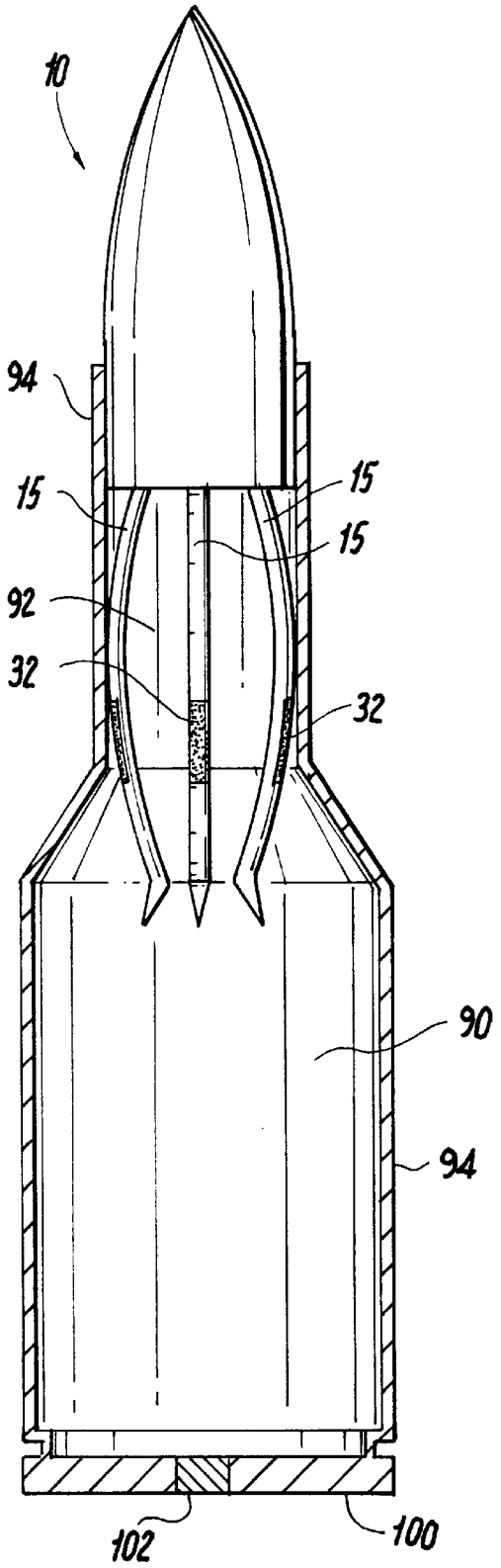
FIG. 4 is a view of the projectile in the restrained condition with the expandable attachment enclosed in a rifle casing.

As previously disclosed, any bullet type may be adapted to utilize the members 15 of the present invention. For example, a rifle cartridge with a necked down end is shown in FIG. 4. The casing comprises a crimp area 94 to hold the projectile body. The members are compressed toward each other such that they assume a restrained position where the member arms fit inside the upper chamber area 92 of the casing. A lower chamber area 90 for holding explosive powder comprises a chamber wall 94, and base 100 with a primer 102. The upper chamber area 92 may additionally be filled with powder in contact with the deformable members 15.

When the bullet is fired, the primer 102 ignites the powder and the expanding gases produced cause the projectile to travel along the barrel of the firearm. The deformable members 15 contact the barrel walls as the projectile 10 travels the length of the barrel, upon exiting the barrel, the deformable members 15 outwardly expand to achieve their unrestrained biased open condition with respect to each other.

Since the member 15 may be made of a hardened material, there is the potential that repeated firing of the projectiles of this invention, may over time lead to scarring or wear on the barrel surface. In the preferred embodiment, the material used for the members 15 should be softer than the barrel material so that minimal barrel wear will take place. Alternatively, the middle portion 30 of the expandable member 15 may have a sacrificial or non-destructive material applied to the contact region 32 of the middle portion 30 of the member 15. This contact region 32 should have sufficient sacrificial material to allow the members 15 to exit the barrel of the firearm without scoring the barrel surface.

The members may be shortened or lengthened based on the available length of the casing. For standard projectiles without necked down ends that may be used in short barrel firearms, the members 15 are located inside the main chamber area of the casing. The contour of the member 15 in the restrained position is configured so that upon compression the hook-like ends will not contact the edges of the casing or the barrel walls as the projectile exits the firearm.

I claim:

1. An expandable attachment for a lethal projectile comprising:

a plurality of deformable open biased members having a plurality of member ends including a joining end and a second end, wherein each of the deformable open biased members is resilient and capable of bending from a first memory position to a second memory position;

wherein the joining end of the deformable members are attached to the rear of the projectile such that upon firing of the projectile, the resilience of the deformable members causes the deformable members to respectively bend from the first memory position to the second memory position to radially expand with respect to each other, springing forward the second member ends with respect to the direction of travel of the projectile, wherein when the projectile is disposed in a barrel of a firing means, with the barrel having an inner barrel wall, each deformable open-biased member includes a contact region engaging the inner wall of the barrel, the contact region of each member is positioned between the respective joining end and the respective second end, and each second end is positioned away from the barrel wall, and wherein, when the projectile penetrates an object, said second member ends of the deformable members, with the deformable members disposed in the second memory position, engage the object to create more widespread destruction of the object, said member ends effectively slowing the projectile once inside the object thereby limiting penetration distance.

2. The expandable attachment for a lethal projectile of claim 1 wherein each deformable open biased member is made of spring steel.

3. The expandable attachment for a lethal projectile of claim 2 wherein the deformable open-biased members have the respective first memory position in an unrestrained condition and the respective second memory position in a restrained condition, the first memory position is naturally assumed when in the unrestrained condition, and the second memory position is assumed in the restrained condition.

4. The expandable attachment for a lethal projectile of claim 3 wherein each deformable open-biased member being coated with a sacrificial material applied to the contact region at a point of contact of the barrel inner wall and the contact region of each member such that when the projectile is fired, the sacrificial material is worn off as the projectile exits the barrel of the firing means thereby limiting damage to the barrel wall as the members scrape along the barrel inner wall.

5. The expandable attachment for a lethal projectile of claim 2 wherein each deformable open-biased member has a substantially flat cross section.

6. The expandable attachment for a lethal projectile of claim 2 wherein the second end of each deformable open-biased member includes a hook.

7. An expandable attachment for a lethal projectile comprising:

a plurality of deformable open-biased members having a plurality of member ends including a joining end and a second end wherein each of the deformable open-biased members is resilient and capable of bending from a first memory position to a second memory position;

wherein the joining end of the deformable members are attached to a mutual connection means, the connection means is mountable on the rear of the projectile such that upon firing of the projectile, the resilience of the deformable members causes the deformable members to respectively bend from the first memory position to the second memory position to radially expand with respect to each other springing forward the second member ends with respect to the direction of travel of the projectile, wherein when the projectile is disposed in a barrel of a firing means, with the barrel having an inner barrel wall, each deformable open-biased member includes a contact region engaging the inner wall of the barrel, the contact region of each member is positioned between the respective joining end and the respective second end, and each second end is positioned away from the barrel wall, and wherein, when the projectile penetrates object, said second member ends of the deformable members, with the deformable members disposed in the second memory position, engage the object to create more widespread destruction of the object, said members effectively slowing the projectile once inside the object effectively limiting penetration distance.

8. The expandable attachment for a lethal projectile of claim 7 wherein each deformable open-biased member is made of spring steel.

9. The expandable attachment for a lethal projectile of claim 8 wherein the deformable open-biased members have the respective first memory position in an unrestrained condition and the respective second memory position in a restrained condition, the first memory position is naturally assumed when in the unrestrained condition, and the second memory position is assumed in the restrained condition.

10. The expandable attachment for a lethal projectile of claim 9 wherein each deformable open-biased member being coated with a sacrificial material applied to the contact region at a point of contact of the barrel inner wall and the contact region of each member such that when the projectile is fired, the sacrificial material is worn off as the projectile exits the barrel of the firing means thereby limiting damage to the barrel wall as the members scrape along the barrel inner wall.

11. The expandable attachment for a lethal projectile of claim 8 wherein each deformable open-biased member has a substantially flat cross section.

12. The expandable attachment for a lethal projectile of claim 8 wherein the second end of each deformable open-biased member includes a hook.

13. The expandable attachment for a lethal projectile of claim 8 wherein the connection means to the base of the projectile includes a weld joint.

14. The expandable attachment for a lethal projectile of claim 8 wherein the connection means to the base of the projectile includes a threaded joint.

15. A firearm cartridge with an expandable attachment comprising:

a casing comprising a base with primer, and a side wall forming a powder chamber with a chamber area;

a projectile with an expandable attachment comprising a plurality of deformable open-biased members having a plurality of member ends including a joining end and a second end, wherein each of the deformable open-biased members is resilient and capable of bending from a first memory position to a second memory position;

wherein the respective joining end of the deformable members are attached to the rear of the projectile, the members naturally disposed by the resilience of the members to extend outward from the first memory position to the second memory position, the members compressed toward each other when in the first memory position, trailing a body of the projectile so that the members in the first memory position may be located inside the chamber area, wherein when the cartridge is disposed in a barrel of a firearm, with the barrel having an inner barrel wall, each deformable open-biased member includes a contact region engaging the inner wall of the barrel, the contact region of each member is positioned between the respective joining end and the respective second end, and each second end is positioned away from the barrel wall, the chamber area filled with powder surrounding the deformable members;

wherein upon firing of the projectile, the primer igniting the powder, the expanding gases therefrom causing the projectile to travel along the barrel of the firearm, the deformable members contact the barrel walls as the projectile travels the length of the barrel, upon exiting the barrel the deformable members outwardly expand to respectively bend from the first memory position to the second memory position to achieve an unrestrained condition with respect to each other, springing forward the second member ends with respect to the direction of travel of the projectile, wherein when the projectile penetrates an object, said second member ends engage the object to create more widespread destruction of the object, said second member ends effectively slowing the projectile once inside the object thereby limiting penetration distance.

16. The expandable attachment for a lethal projectile of claim 15 wherein each deformable open-biased member is made of spring steel.

17. The expandable attachment for a lethal projectile of claim 16 wherein the deformable open-biased members have the respective first memory position in the unrestrained condition and the respective second memory position in a restrained condition, the first memory position is naturally assumed when in the unrestrained condition, and the second memory position is assumed in the restrained condition.

18. The expandable attachment for a lethal projectile of claim 17 wherein each deformable open-based member being coated with a sacrificial material applied to the contact region at a point of contact of the barrel inner wall and the contact region of each member such that when the firearm cartridge is fired, the sacrificial material is worn off as the projectile from the firearm cartridge exits the barrel of the firearm thereby limiting damage to the barrel inner wall as the members scrape along the barrel inner wall.

19. The expandable attachment for a lethal projectile of claim 16 wherein each deformable open-biased member has a substantially flat cross section.

20. The expandable attachment for a lethal projectile of claim 16 wherein the second end of each deformable open-biased member includes a hook.

* * * * *